United States Patent [19]

Strunk

[11] 4,099,355

[45] Jul. 11, 1978

[54] PANELING OF FIREPROOF INSULATING ELEMENTS FOR WALLS, FLOORS AND CEILINGS

[75] Inventor: Ernst-Joachim Strunk, Weitefeld, Fed. Rep. of Germany

[73] Assignee: Horst Lampertz, Wallmenroth, Sieg, Fed. Rep. of Germany

[21] Appl. No.: 812,389

[22] Filed: Jul. 1, 1977

[30] Foreign Application Priority Data

Jul. 7, 1976 [DE] Fed. Rep. of Germany ..... 2630479

[51] Int. Cl.[2] ..... E04B 1/74

[52] U.S. Cl. ..... 52/404; 52/461

[58] Field of Search ..... 52/404, 461, 468, 613–615, 52/620, 459, 621

[56] References Cited

U.S. PATENT DOCUMENTS

| | | | |
|---|---|---|---|
| 3,024,879 | 3/1962 | Kandra | 52/613 |
| 3,113,401 | 12/1963 | Rose | 52/461 |
| 3,357,146 | 12/1967 | Gartrell | 52/620 X |
| 3,367,076 | 2/1968 | O'Brien | 52/620 |
| 3,512,819 | 5/1970 | Morgan et al. | 52/461 |
| 3,760,544 | 9/1973 | Hawes et al. | 52/468 |
| 3,760,548 | 9/1973 | Sauer et al. | 52/404 |

*Primary Examiner*—J. Karl Bell

*Attorney, Agent, or Firm*—Young & Thompson

[57] ABSTRACT

Paneling of fireproof insulating elements for walls, floors and ceilings, comprises a plurality of metal-sheathed panels in edgewise abutting relationship. The panels are filled with endothermally variable insulating material that absorbs a great deal of heat during its phase change. To permit the panels to be welded together at their butt joints, the panels have double metal walls adjacent these joints, there being insulation within the double metal walls thereby to protect the endothermally variable insulating material from the heat of welding. A semi-solid, flexible insulating composition can be disposed in the butt joints. External insulating paneling, also arranged in edgewise abutting relationship, can be provided, the butt joints of the external paneling being offset from those of the internal paneling.

3 Claims, 7 Drawing Figures

PANELING OF FIREPROOF INSULATING ELEMENTS FOR WALLS, FLOORS AND CEILINGS

The invention relates to paneling of fireproof insulating elements having a filling of endothermally variable insulating material for walls, floors, and ceilings of rooms for storing temperature-sensitive articles, such as magnetic tapes, films, data carriers, and the like. The insulating effect of the elements is based on the fact that the heat absorption capacity of the filling composition is substantially increased, as compared to the heat absorption capacity at normal temperatures, by an endothermal change of the physical condition before reaching the maximally permissible temperature.

Insulating elements of this type are known which consist of concrete, wood, mineral fiber materials, or temperature-stable foam materials and which satisfy the regulations according to DIN (German Industrial Standard) 4102. This standard requires certain thermal insulating properties to be exhibited by insulating elements, but does not indicate anything regarding the permissible room temperatures of a room insulated in this way in case of a fire, as prescribed, for example, in the VDMA (Verein Deutscher Maschinenbau-Anstalten, or Association of German Mechanical Engineers) Standard Leaflet 24991.

Furthermore, fireproof cabinets are conventional, the insulating effect of which is based on the fact that the heat penetrating into the cabinet from the outside is absorbed by an endothermal change of the structural condition of the insulating material. However, fireproof cabinets of this type have a relatively low capacity with comparatively high technical expenditure and therefore are relatively expensive, especially if a larger quantity of magnetic tapes or other data carriers requires the installation of a plurality of such cabinets.

The invention is primarily based on the problem of providing a paneling of fireproof insulating elements with a filling of endothermally changeable insulating material for walls, floors, and ceilings, wherein the insulating elements can be manufactured in any desired dimension and can be mounted by electrical or mechanical connections on the site. In this connection, the concrete shell of the room, consisting of the walls, the ceilings, and the floor, can serve as the heat-insulating outer shell, and the insulating elements of this invention with their filling of an endothermally variable insulating material, the physical state of which changes at high temperatures with a simultaneous increase in the heat absorption capacity, constitute the internal insulation.

According to the invention, this problem is solved essentially in that the insulating elements have, in the zone of the abutting surfaces, a double wall with an internal insulation.

According to a further feature of the invention, the insulating elements can be detachably joined together or they can be welded to one another.

In case of a partial fireproof paneling of rooms, it is necessary to produce multiple-layer insulating elements consisting of various thermal insulating materials in order to separate the space to be insulated from the remaining, free space; in this connection, at least one layer consists of an endothermally variable insulating material. In such partially insulated rooms, the insulating effect is improved, in an advantageous further development of the invention, by arranging the butt joints of the external insulating elements to be offset with respect to the butt joints of the internal insulating elements which contain an endothermally variable filling composition.

If, during the installation of the paneling according to this invention, the insulating elements are welded together, short-term heating occurs of the sheet-metal casings of the insulating elements with the filling of endothermally variable insulating material, resulting in an undesired change in the physical condition of the insulating material. This disadvantageous phenomenon occurring during the welding step is counteracted by fashioning the double wall with an internal insulation in the zone of the abutting surfaces of the individual insulating elements.

A further possibility of preventing the effect of the welding heat on the filling material of the insulating elements resides in that, prior to introducing the insulating material into the elements, angles or U-shaped strips are welded to the elements which are joined together by means of a mounting strip or the like pushed thereover.

The insulating capacity of the paneling according to this invention is, finally, still further substantially increased by sealing the butt joints between the individual insulating elements with a preferably semisolid, flexible insulating composition.

Additional details of the invention can be seen from the following description of embodiments illustrated in the drawings wherein:

FIG. 6 shows a cross section of the butt joint of two internal insulating elements according to FIG. 5; while

Figure 1:
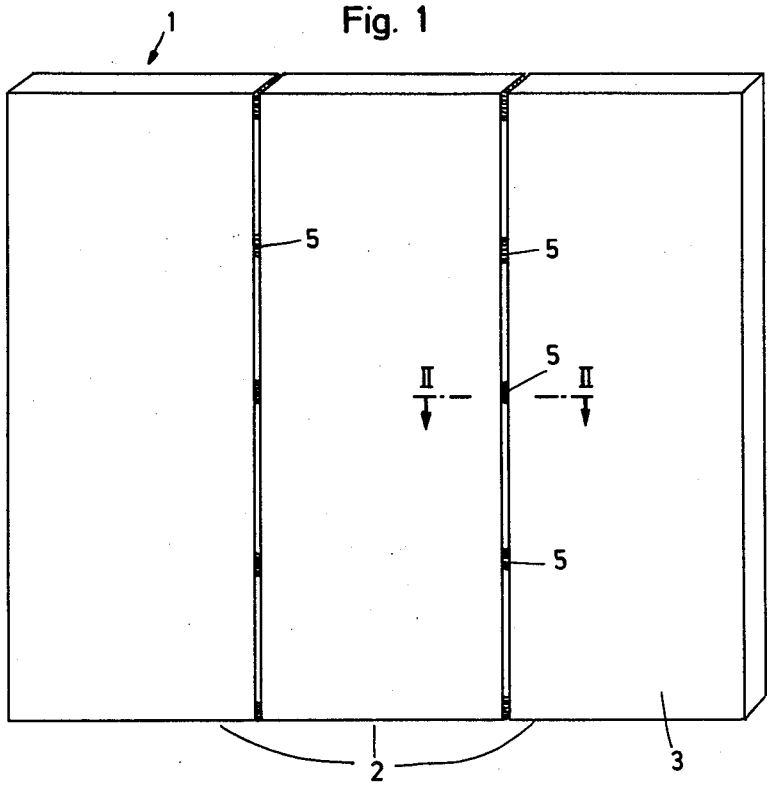
FIG. 1 is a perspective view of a paneling consisting of the insulating elements of the invention.
Figure 2:
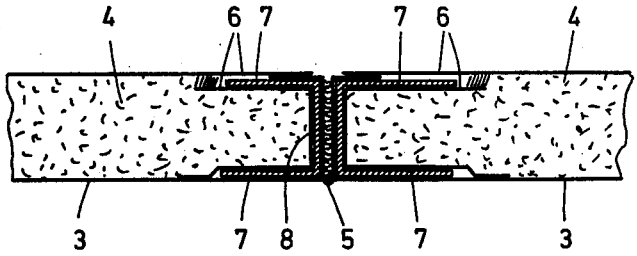
FIG. 2 shows a cross section along line II-II of FIG. 1.

The paneling 1 according to FIGS. 1 and 2 consists of insulating elements 2 placed one against the other and comprising a square sheet-metal casing 3 with a filling 4 of an endothermally variable insulating material, e.g. sodium silicate or potassium silicate or the like that melts at about 1000° C. The insulating elements 2 are joined together by a number of short welding seams 5. As shown in FIG. 2, the insulating elements 2 have, in the zone of the butt surfaces, a double wall 6 with an internal insulation 7, e.g. of asbestos or ceramic insulating material, preventing the transmission of the welding heat to the insulating element filling 4 of endothermally variable material. To increase the insulating effect, the butt joints between the individual insulating elements 2 are sealed off by a semisolid, flexible insulating composition 8, e.g. ceramic fibers of a thickness of about 1 micron in a mastic binder.

Figure 3:
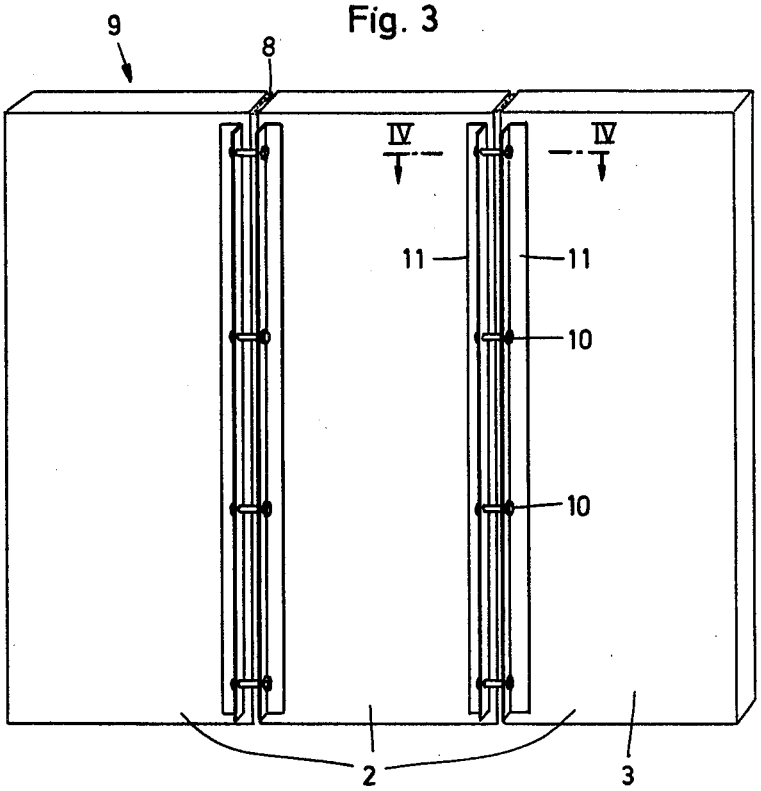
FIG. 3 shows a perspective view of a second embodiment of the paneling according to the invention.
Figure 4:
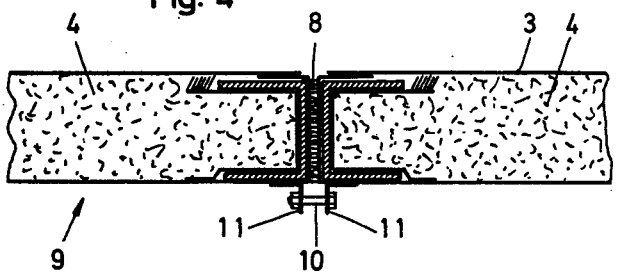
FIG. 4 shows a cross section along line IV-IV of FIG. 3.

In the paneling 9 according to FIGS. 3 and 4, the insulating elements 2 are connected by screws, wherein the connecting screws 10 hold together the junction strips 11 with an L-shaped profile arranged in the zone of the butt joint of two adjacent insulating elements. A semisolid, flexible insulating composition 8 is provided between the insulating elements 2, as in the paneling according to FIGS. 1 and 2.

Figure 5:
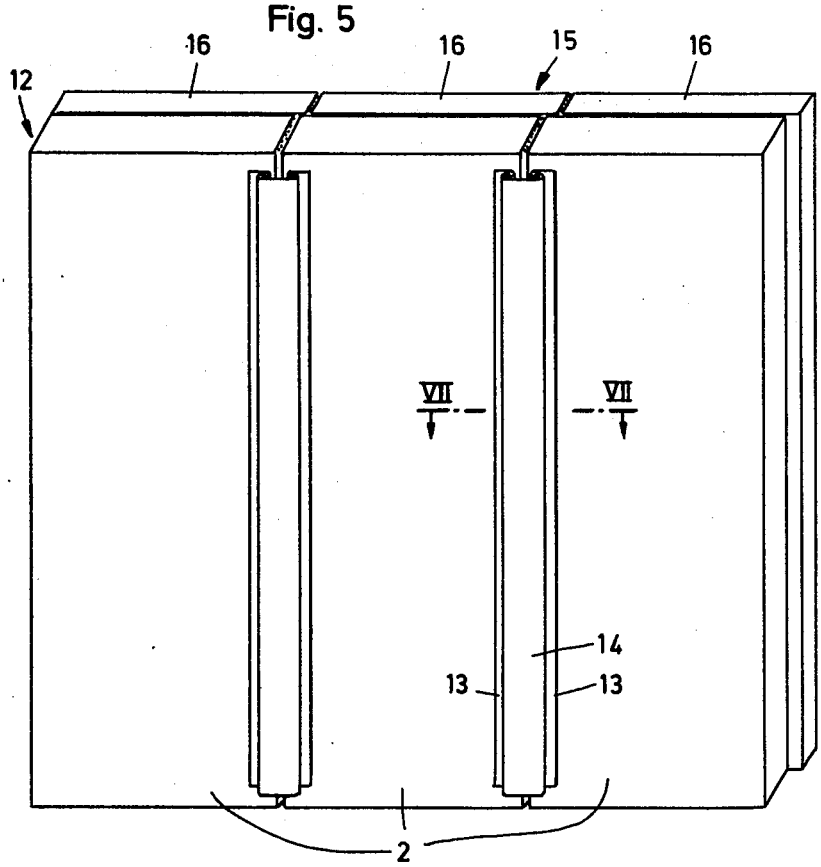
FIG. 5 shows a perspective view of a third embodiment of the paneling according to the invention.
Figure 6:
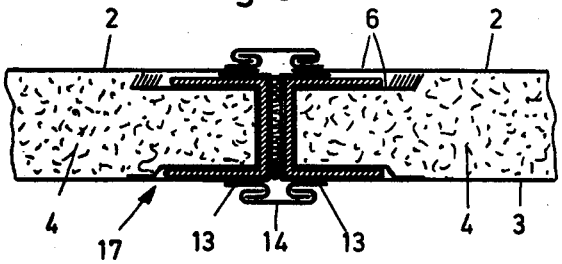

In the paneling 12 shown in FIGS. 5 and 6, the insulating elements 2 have, in the zone of the abutting surfaces, a connecting strip 13 with a U-shaped profile. During the mounting of the paneling 12, a clamping strip 14 is pushed over the connecting strips 13 of two neighboring insulating elements 2. To render rooms fireproof, the paneling 12 has an external insulation 15 of concrete panels 16. To increase the insulating effect, the butt joints of the insulating elements 2 of the paneling 12 constituting the internal insulation 17 and the butt joints of the concrete panels 16 of the external insulation 15 are arranged to be offset with respect to one another.

Figure 7:
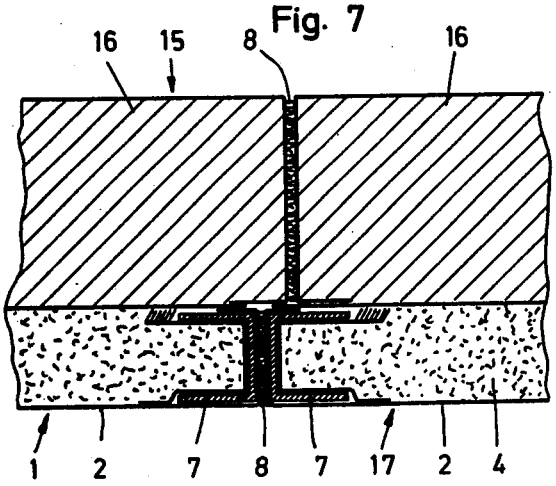
FIG. 7 shows a cross section of the butt joint of two internal and external insulating elements of the paneling along line VII—VII of FIG. 5 wherein, in a modification of the embodiment of FIG. 5, the insulating elements are welded together in accordance with the embodiment of FIG. 1.

FIG. 7 shows a paneling 1 in accordance with FIG. 1 as an internal insulation 17 consisting of welded-together insulating elements 2, with an external insulation 15 of concrete panels 16, wherein the butt joints of the concrete panels 16 and of the insulating elements 2 are arranged to be offset with respect to each other and are sealed off as before by a semisolid, flexible insulating composition 8.

What is claimed is:

1. Paneling for walls, floors, and ceilings, comprising a plurality of panels in edgewise abutting relation, each panel comprising a metal casing with a filling of endothermally variable insulating material, the panels having, in the zone of their abutting edges, a double metal wall, insulating material within the double metal wall, and external insulating panels in edgewise abutting relationship with each other and overlying the first-mentioned panels, the butt joints between the external panels being offset with respect to the butt joints between the first-mentioned panels.

2. Paneling according to claim 1, said panels being welded together in the region of said double walls.

3. Paneling according to claim 1, and a semisolid, flexible insulating composition disposed between the abutting edges of said external panels.

* * * * *